US007421961B2

(12) United States Patent
Hardwig et al.

(10) Patent No.: US 7,421,961 B2
(45) Date of Patent: Sep. 9, 2008

(54) FABRIC HAVING A REMOVABLE MONOFILAMENT GUIDE

(76) Inventors: Nancy Sue Hardwig, 2213 Windsor Ct., Bloomington, IL (US) 61704; Ronald B. Hardwig, 2213 Windsor Ct., Bloomington, IL (US) 61704

( * ) Notice: Subject to any disclaimer, the term of this patent is extended or adjusted under 35 U.S.C. 154(b) by 379 days.

(21) Appl. No.: 11/253,784

(22) Filed: Oct. 19, 2005

(65) Prior Publication Data

US 2007/0095265 A1 May 3, 2007

(51) Int. Cl.
*D05B 97/08* (2006.01)
*D05B 93/00* (2006.01)

(52) U.S. Cl. ..... 112/475.01; 112/439; 112/475.22

(58) Field of Classification Search ..... 112/475.01, 112/475.18, 475.22, 416, 429, 432, 439; 66/169 R, 202; 28/140, 151; 139/383 R, 139/420 R, 420 A
See application file for complete search history.

(56) References Cited

U.S. PATENT DOCUMENTS 1,833,705 A * 11/1931 Botts ..... 66/172 R
1,869,386 A 8/1932 Marzak
2,157,573 A 5/1939 Sadtler
2,272,229 A 2/1942 Tucker
3,579,766 A * 5/1971 Feinberg ..... 28/153
3,779,190 A 12/1973 Hower
3,860,046 A * 1/1975 Goff et al. ..... 139/421
4,154,181 A 5/1979 Massucci et al.
4,310,313 A 1/1982 Brundige
4,447,483 A 5/1984 Graham et al.
4,465,007 A 8/1984 Strobel
4,530,665 A 7/1985 Colonel
5,015,220 A * 5/1991 Legge et al. ..... 474/256
6,003,344 A * 12/1999 Castano ..... 66/169 R
6,505,652 B1 * 1/2003 Matsushima ..... 139/384 B
6,510,873 B2 * 1/2003 Nagura ..... 139/383 A
6,823,900 B2 * 11/2004 Wildeman et al. ..... 139/391

FOREIGN PATENT DOCUMENTS

EP 000393450 A1 * 10/1990

* cited by examiner

*Primary Examiner*—Ismael Izaguirre
(74) *Attorney, Agent, or Firm*—Robert C. Haldiman; Husch Blackwell Sanders LLP

(57) ABSTRACT

The use of monofilament line to form a grid in the cross stitch fabric corresponding to the grid in a cross stitch pattern to facilitate the cross stitching process, after which the monofilament line can be easily removed by pulling from either end. The monofilament line has the distinct advantage of being resistant to piercing by the needle and cross stitch thread during the cross stitching process, and thus not being woven into the design as guide thread would do.

21 Claims, 4 Drawing Sheets

PRIOR ART

FABRIC HAVING A REMOVABLE MONOFILAMENT GUIDE

CROSS-REFERENCE TO RELATED APPLICATIONS

None.

BACKGROUND OF THE INVENTION

1. Field of the Invention

The present invention relates to sewing and more particularly to ornamental stitching.

2. Related Art

Fabric employed in counted cross stitch generally has the same number and size threads going both crosswise and lengthwise per inch. This fabric provides a true square when cross stitch is used across the same number of threads in each direction, usually four across and four up and down. A needle and thread or yarn is employed to provide a decoration on the cross stitch fabric which, itself, is attractive and need not be entirely covered by the embroidery yarn or thread.

Conventional patterns for counted thread cross stitch are printed on paper having a grid printed thereon similar to graph paper wherein horizontal and vertical heavy lines define blocks containing one hundred small squares, ten squares horizontally and ten squares vertically. Different symbols are printed in the various squares denoting different colored threads to be employed and the different types of stitches to be made in the fabric. Patterns may be small and simple or large and complicated requiring many different shades and colors of thread or yarn. A completely filled block of one hundred squares requires the needle to enter and leave the fabric at least two hundred times. Many decorative pictures will have many blocks, some filed completely and others filled partially, in random patterns. Using the correct color thread in the precise correct small square is a tedious process. Heretofore, a cross stitcher had to start the cross stitch work at a selected point along one side of the fabric. All subsequent stitches were made in relation to the previous ones by counting squares on the paper pattern and then threads of the fabric, working across the fabric one line at a time.

To overcome the tedious process of transferring the information contained on the paper pattern to the use of the proper colored thread at the correct location on the fabric, it has been proposed to superimpose a pattern sheet on the fabric and then cross stitch the fabric by inserting the needle and colored yarn through the pattern and fabric. After the work is competed, the pattern is removed from the fabric. This proposal has not been universally accepted because it is difficult to keep the pattern aligned with the proper squares in the fabric while performing the work, and when removing the pattern, there is a tendency to loosen or tear the colored yarn from the cross stitch fabric. Another proposal was to weave a colored thread into the fabric as guide lines. This method has also not been universally accepted as during the cross stitching process the guide threads are sewn through making them virtually impossible to remove.

U.S. Pat. No. 4,465,007 issued to Strobel on Apr. 14, 1984 discloses an embroidery fabric having colored guide threads. The guide threads provide a useful grid corresponding to a selected pattern. After the embroidery is completed, the guide threads are removed leaving the embroidered pattern intact. While the guide threads do provide a useful grid, there are several drawbacks to using a thread material for a guide. Those of ordinary skill in the art understand that a thread is a light, fine, string-like length of material made up of two or more fibers or strands of spun cotton, flax, silk, etc. twisted together and used in sewing. Due to its inherent characteristics, it is possible to sew through thread such that the guide line cannot be readily removed. Additionally, and also due to its inherent characteristics, guide threads frictionally engage the fabric to which they are sewn. As such, it is often not possible to simply pull on the guide threads to remove them upon completion of the cross-stitch pattern. With these drawbacks, it is often necessary to cut each guide thread and remove it in several pieces. This method of guide thread removal is often tedious and time consuming.

Therefore, there remains a need in the art for a cross-stitch guide that is resistant to piercing by a sewing needle and which does not frictionally engage the fabric underlying a cross-stitch pattern.

SUMMARY OF THE INVENTION

To overcome the disadvantages experienced in previous cross stitch methods, the fabric of the present invention has been devised which includes a conventional woven fabric having horizontally and vertically monofilament guide lines woven therein in such a manner to correspond to the heavier lines on the conventional paper pattern forming a grid of blocks each having small squares contained therein. By this construction and arrangement, the fabric can be cross stitched more easily because the grid structure formed by the monofilament guide lines facilitates the determination whether a particular pattern will fit on a piece of fabric, and more importantly they facilitate the use of the same color of thread or yarn in the various groups or blocks throughout the pattern before using another color of yarn or thread. After the cross stitching is completed, the monofilament guide lines forming the grid are very easily removed from the fabric as the monofilament line cannot be pierced by the needle and thread during the cross stitch process leaving them free to be removed.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
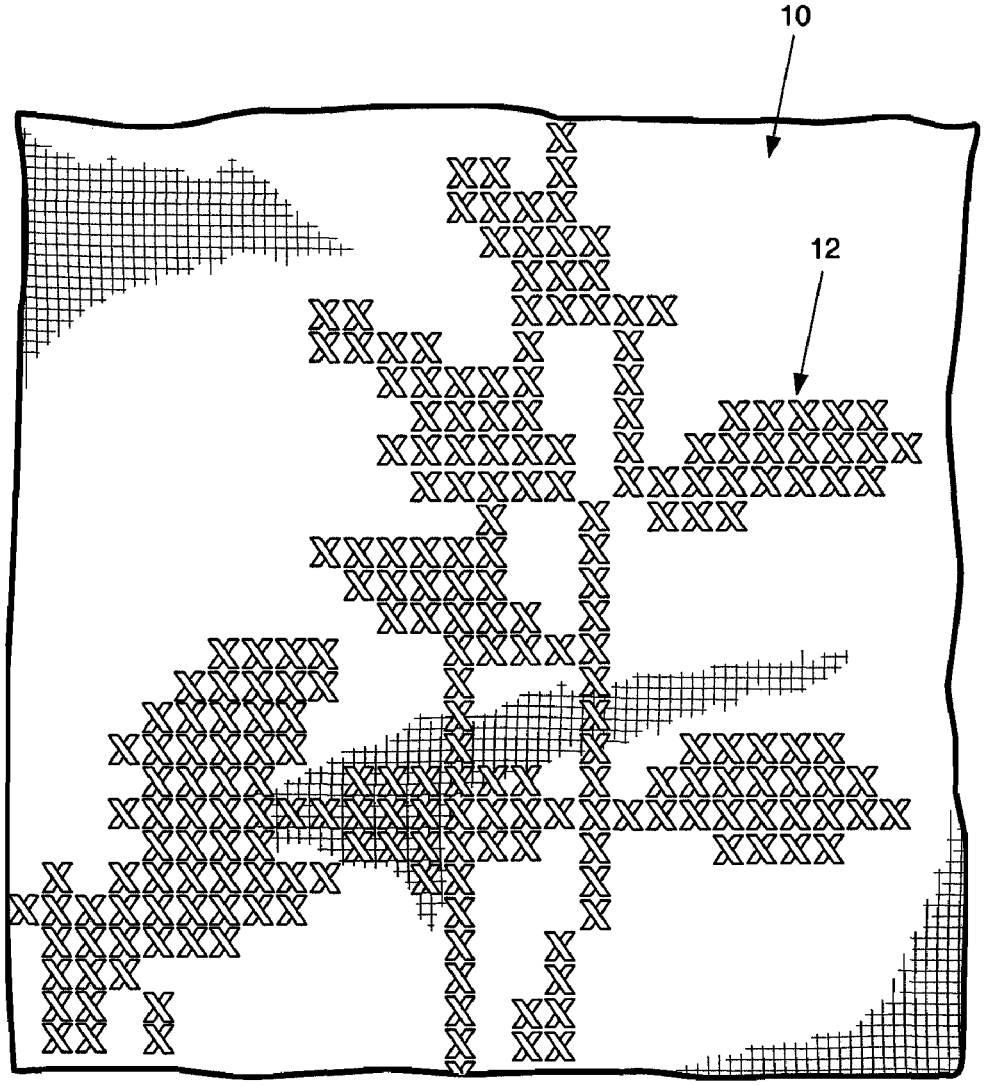
FIG. 1 is a partial top plan view of an embroidered fabric.

Referring to the drawings starting with FIG. 1 thereof, a cross stitch fabric 10 is shown having a cross stitch 12 of colored yarn or thread thereon to provide a decoration. In the depicted embodiment, the fabric is an evenweave fabric. That is, the fabric has the same number and size threads going both crosswise and lengthwise per inch and forms a specific number of holes per inch equal in both directions. In other words, an evenweave is any fabric which has the same number of threads per inch in both the vertical and horizontal directions. Evenweaves generally have a stitch count of twenty-five or more stitches per one inch (2.5 cm). While an evenweave fabric is shown in the depicted embodiments, other types of fabrics may be used in accordance with the present invention. For example, a linen or aida-type fabric may equally be used. A linen fabric is any fabric made of flax. Aida cloth is a coarse open-weave fabric that comes in various even sizes, indicating the number of squares per inch. Aida usually comes in 8, 11, 14, 16, and 18 blocks per one inch (2.5 cm). Aida is worked with one stitch over one square, while linen and other evenweaves are generally worked over two squares. Typical fabric sizes are 14 inches by 18 inches (35 by 45 cm) and 20 inches by 30 inches (50 by 75 cm).

Figure 2:
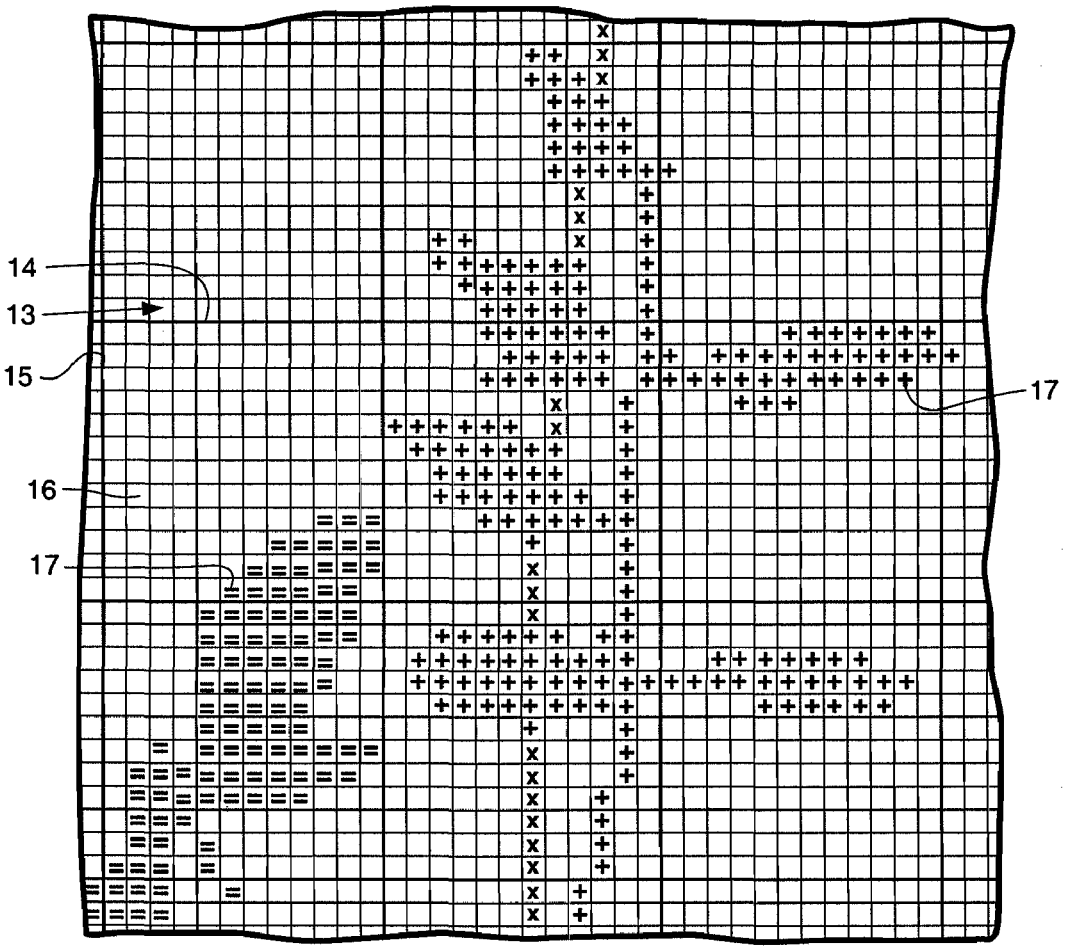
FIG. 2 is a partial top plan view a conventional paper pattern.

In order that the proper colored yarn or thread 12 is stitched into the fabric 10 at the proper location, a conventional paper pattern 13 is provided as shown in FIG. 2. The paper pattern is similar to graph paper wherein horizontal lines 14 and vertical lines 15 define blocks normally containing one hundred small squares 16, ten squares horizontally and ten squares vertically. Some of the squares contain indicia or symbols 17 denoting the different colored threads 12 to be employed in the fabric 10. In the depicted embodiment, the symbol + indicates the use of pale blue green, × indicates the use of light green, and = indicates the use of green.

For any one pattern, symbols are used to denote the various colors to be stitched and if the stitch should be a full stitch, that is one stitched in both diagonal directions or a half stitch, meaning one stitched in just one diagonal direction only. Following the symbols contained on the paper pattern 13 (FIG. 2) denoting the color thread 12 in the correct small square in the fabric 10 is a tedious process because the cross stitcher is required to select a point along one side of the fabric 10 to start the cross stitch work and all subsequent stitches 12 are made in relation to the previous ones by counting the squares 16 in the paper pattern 13 and then in the fabric 10, normally starting at the center line half way up the pattern and then working from left to right.

Figure 3:
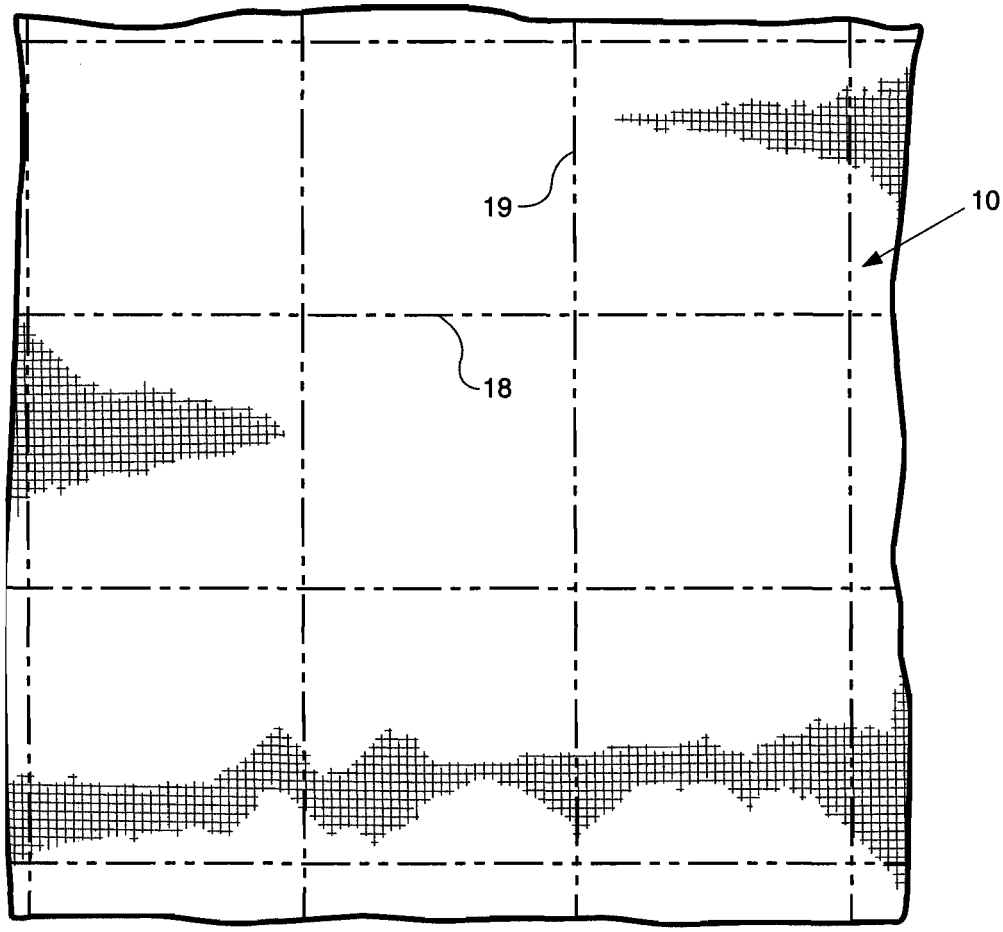
FIG. 3 is a partial top of a fabric having monofilament guide lines.
Figure 4:
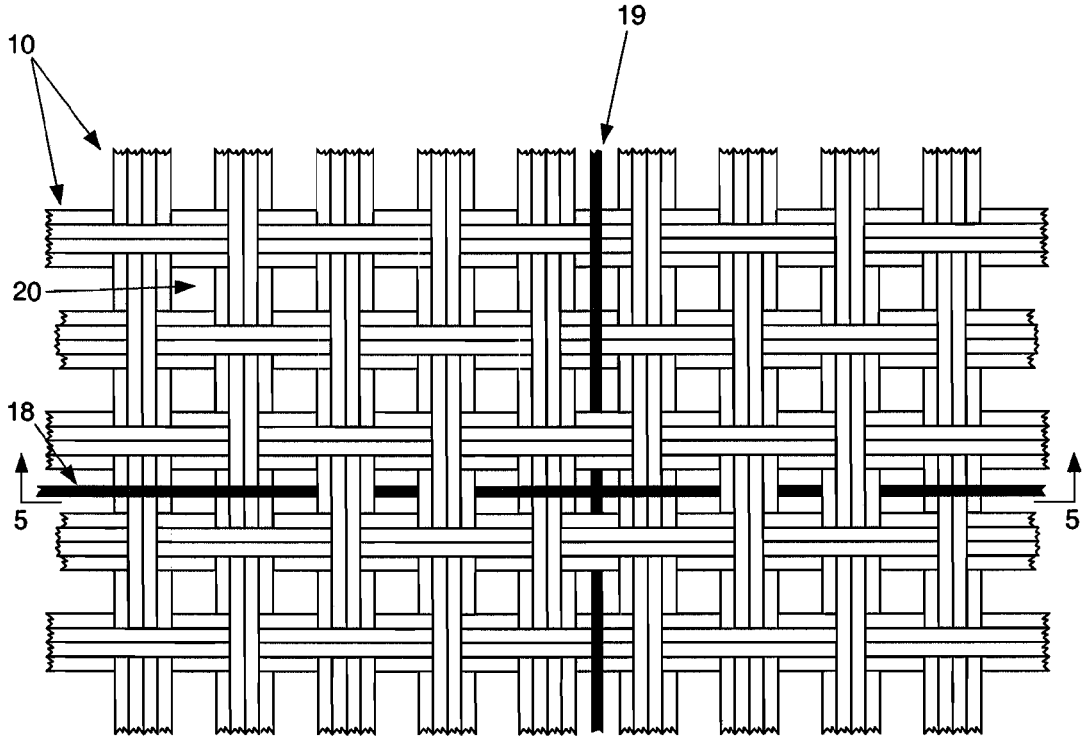
FIG. 4 is an enlarged partial top plan view of the fabric having monofilament guide lines.
Figure 5:
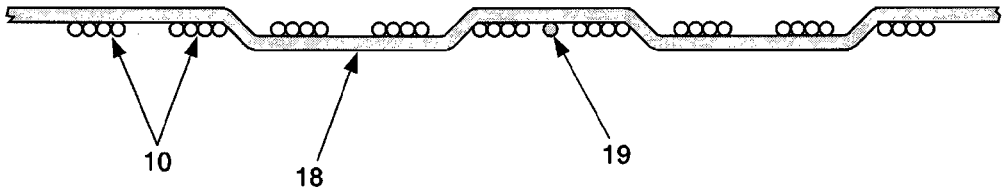
FIG. 5 is a sectional view taken along line 5-5 in FIG. 4.

To overcome this tedious process, the fabric of the present invention has been devised as shown in FIGS. 3, 4, 5 and includes the cross stitch fabric 10 as shown and described in connection with FIG. 1; however, the fabric is provided with monofilament guide lines 18 and 19 (as best seen in FIGS. 3, 4, and 5) extending horizontally and vertically, respectively. As those skilled in the art will understand, a monofilament is a single untwisted strand of synthetic material. The monofilament guide lines are woven into the fabric 10 in such a manner to correspond to the heavier lines 14 and 15 on the paper pattern 13 (as best seen in FIG. 2) to thereby form a grid of blocks. In the depicted embodiment, the grid has one hundred small squares 20 (as best seen in FIG. 4). While FIGS. 4 and 5 show the monofilament line being woven over two then under two groups of lines in the cross stitch fabric, this is merely representative. It is understood that the actual weave could be made in a number of different ways and still achieve the same result. It has been found that even if the monofilament guide lines are stitched with long stitches the cross stitcher's eye can very easily project the line between intermittent stitches. However, due to the low friction characteristics of the monofilament guide line, the monofilament guide lines 18, 19 may be stitched very tightly, such as every line, and still be removed quite easily.

The monofilament guide lines 18, 19 are made from a synthetic material, such as nylon or polyethylene. In the depicted embodiments, the guide lines 18, 19 are made from nylon. However, those skilled in the art would understand that co-filament material, meaning material having an inner and an outer wrap of nylon, microfilaments of gel spun polyethylene fibers fused together to produce a single strand of material, or strands of carbon bonded polymers of fluorine could equally be used. The guide lines 18, 19 may be any number of colors, such as clear, red, pink, green, blue, white, black, or gold. In general, cross stitch fabrics may be of any number of colors, and the color of the monofilament guide line is selected to contrast with the color of the underlying cross stitch fabric. The contrast in colors allows the cross stitcher to more readily see the monofilament guide line. In the depicted embodiments, the guide lines 8, 9 are a red monofilament material obtained from Glassmaster Company, 126 Glassmaster Road, Lexington, S.C., 29072-3710.

By this construction and arrangement, the fabric 10 can be cross stitched more easily because the grid structure formed by the colored monofilament guide threads 18 and 19 facilitate the determination whether a particular pattern will fit on a piece of fabric 10 and greatly facilitates the use of the same color of thread or yarn 12 in the various groups or blocks in the pattern before using another color. After the cross stitching process is completed, the monofilament guide lines 18 and 19 are removed from the fabric to provide a completed cross stitched fabric as shown in FIG. 1 with no guide lines. Because the monofilament guide lines 18, 19 cannot easily be pierced by a needle and do not frictionally engage the fabric 10 to a significant degree, the monofilament guide lines 18, 19 can easily be removed. Moreover, in the case of a nylon monofilament guide line, the guide lines have a smooth, glossy surface that allows the monofilament guide to be pulled out smoothly. Thus, the nylon monofilament guide line can be removed with a gentle, constant motion.

While the fabric of the present invention has been described wherein the monofilament guide lines 18 and 19 are woven into the fabric 1 to form a grid of blocks each having one hundred small squares 20, it is understood that the monofilament guide lines 18 and 19 can be woven into the fabric to form a grid of blocks containing any number of squares 20. It should also be understood that any reference to cross stitch work would also apply to needlepoint work.

The present invention also includes a method of manufacturing a woven fabric having monofilament guide lines. The method includes the steps of providing a loom, mounting a warp thread on the loom, intersecting a weft thread with the warp thread, mounting a warp monofilament guide line on the loom, and intersecting a weft monofilament guide line with the warp thread. The loom may be any number of standard looms, such as a manual loom, a power loom, or a Jacquard loom. The warp and weft threads may be made from any number of materials, such as spun cotton, flax, silk, etc. The monofilament guide lines may alternate with the thread in order to reduce the overall costs of the woven fabric. As examples, every tenth or hundredth warp or weft line may be a monofilament guide line. The warp and weft monofilament guide lines may alternate with the threads to form a visible grid on the woven fabric. The monofilament guide lines may be clear or colored. Additionally, the warp and weft monofilament guide lines may be of different colors. For example, the warp monofilament guide line may be red, whereas the weft monofilament guide line may be green. The method of manufacturing a woven fabric having monofilament guide lines is significant because it significantly reduces the preparation time for a cross stitch project. As an example, a pre-made fabric having monofilament guide lines eliminates the time necessary to install a monofilament grid into an existing cross stitch fabric. The elimination of this step reduces the overall project completion time by an hour or more.

The present invention also includes a method of manufacturing a fabric made of only monofilament lines. The method includes the steps of providing a loom, mounting a warp monofilament line on the loom, and intersecting a weft monofilament line with the warp thread. The warp and weft monofilament lines would be repeatedly weaved on the loom to achieve the desired fabric size. The fabric may also incorporate monofilament guide lines of a different color to form a grid to coordinate with the cross stitch pattern. The fabric of monofilament lines is used as a waste material which is removed upon completion of the pattern. In other words, the cross stitcher would stitch a pattern onto an item, such as an article of clothing, using the monofilament fabric, and after the pattern is completed, the cross stitcher would remove all of the monofilament lines and guide lines leaving only the pattern in place.

A method of cross stitching is also disclosed. The method includes the steps of providing a fabric, providing a pattern, identifying a center of the fabric, interlacing a first monofilament guide line with the fabric at the center, interlacing a second monofilament guide line with the fabric at the center, wherein the second monofilament is generally perpendicular to the first monofilament guide line, stitching the pattern onto the fabric, and removing the first and the second monofilament guide lines. The monofilament guide lines may be clear or colored. Additionally, the monofilament guide lines may be of different colors. For example, the one monofilament guide line may be red, whereas the other monofilament guide line may be green.

Also disclosed is a kit for use with an existing cross stitch pattern. The cross stitcher would utilize the kit to sew in his or her own guide lines on existing cross stitch fabric. The kit includes monofilament guide lines and instructions. The monofilament guide lines are adapted for weaving into cross stitch fabric to thereby form a grid of blocks containing a corresponding number of open squares on the fabric. The monofilament guide lines correspond to the heavier lines noted on the cross stitch paper pattern. The monofilament guide lines may be of a different color than the cross stitch fabric and are removable from the cross stitch fabric upon completion of imposing the cross stitch pattern upon the cross stitch fabric. The instructions detail the steps for installing the monofilament guide lines into the cross stitch fabric and the steps for removing the monofilament guide lines upon completion of the pattern. In some embodiments, the kit may also include cross stitch fabric and/or a cross stitch pattern.

As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A fabric having a grid for use with a cross stitch pattern, said grid comprising a plurality of removable monofilament guide lines, said removable monofilament guide lines being generally disposed in a horizontal direction and a vertical direction, and said removable monofilament guide lines being made of a synthetic material.

2. The fabric according to claim 1, wherein said synthetic material is selected from the group consisting of nylon, polyethylene, co-filament material, microfilaments of gel spun polyethylene fibers fused together, and strands of carbon bonded polymers of fluorine.

3. The fabric according to claim 1, wherein each of said plurality of removable guide lines have a color, and said color is selected from the group consisting of clear, red, pink, green, blue, white, black, and gold.

4. The fabric according to claim 1, wherein each of said plurality of removable guide lines have a color, and said color contrasts with a color of the fabric.

5. The fabric according to claim 1, wherein each of said plurality of removable guide lines is resistant to piercing.

6. A woven fabric for use in cross stitching, the woven fabric comprising:

a. a plurality of removable horizontally disposed monofilament guide lines; and b. a plurality of removable vertically disposed monofilament guide Lines, said plurality of vertically disposed monofilament guide lines being generally perpendicular to said plurality of horizontally disposed monofilament guide lines such that said plurality of removable horizontally disposed monofilament guide lines and said plurality of removable vertically disposed monofilament guide lines form a grid for use with a cross stitch pattern.

7. The woven fabric according to claim 6, wherein said grid has a color, and said color is selected from the group consisting of clear, red, pink, green, blue, white, black, and gold.

8. The woven fabric according to claim 6, wherein there are ten removable horizontally disposed monofilament guide lines and ten removable vertically disposed monofilament guide lines.

9. The woven fabric according to claim 6, wherein each of said plurality of removable guide lines is resistant to piercing.

10. The woven fabric according to claim 6, wherein said plurality of removable horizontally disposed monofilament guide lines and said plurality of removable vertically disposed monofilament guide lines are made of a synthetic material and said synthetic material is selected from the group consisting of nylon, polyethylene, co-filament material, microfilaments of gel spun polyethylene fibers fused together, and strands of carbon bonded polymers of fluorine.

11. The woven fabric according to claim 6, further comprising the same number and size of threads going both crosswise and lengthwise per inch to form a specific number of holes per inch equal in both directions.

12. The woven fabric according to claim 6, further comprising threads made of flax.

13. A method of manufacturing a fabric with monofilament grid lines, the method comprising the steps of:

a. providing a loom;

b. mounting a warp monofilament guide line on the loom; and c. intersecting a weft monofilament guide line with the warp monofilament guide line to form a fabric having removable monofilament guide lines.

14. The method according to claim 13, further comprising the steps of:

a. mounting a warp thread on said loom; and b. intersecting a weft thread with the warp thread.

15. The method according to claim 14, wherein the steps of intersecting a weft thread with the warp thread and intersecting a weft monofilament guide line with the warp thread are alternated to form a pattern.

16. The method according to claim 14, wherein the warp and weft monofilament guide lines may alternate with the warp and weft threads to form a visible grid on the woven fabric.

17. The method according to claim 16, wherein said grid has a color, and said color is selected from the group consisting of clear, red, pink, green, blue, white, black, and gold.

18. A method of cross-stitching, the method comprising the steps of:

a. providing a fabric;

b. providing a pattern;

c. identifying a center of said fabric;

d. interlacing a first monofilament guide line with the fabric at the center;

e. interlacing a second monofilament guide line with the fabric at the center, wherein said second monofilament is generally perpendicular to said first monofilament guide line;

f. stitching said pattern onto said fabric; and g. removing the first and the second monofilament guide lines.

19. A kit for use with a cross stitch pattern comprising:

a. a cross stitch fabric;

b. monofilament guide lines of a synthetic material adapted for weaving into the cross stitch fabric to thereby form a grid of blocks containing a corresponding number of open squares on the fabric, the monofilament guide lines corresponding to the heavier lines noted on the cross stitch paper pattern, said monofilament guide lines being of a different color than the cross stitch fabric and removable from the cross stitch fabric upon completion of imposing the cross stitch pattern upon the cross stitch fabric.

20. The kit according to claim 19, wherein said synthetic material is selected from the group consisting of nylon, polyethylene, co-filament material, microfilaments of gel spun polyethylene fibers fused together, and strands of carbon bonded polymers of fluorine.

21. The kit according to claim 19, wherein each of said monofilament guide lines have a color, and said color is selected from the group consisting of clear, red, pink, green, blue, white, black, and gold.

* * * * *